US010017296B2

(12) United States Patent
Burk

(10) Patent No.: US 10,017,296 B2
(45) Date of Patent: Jul. 10, 2018

(54) HIGH LOAD PLASTIC PALLET

(71) Applicant: Ryan Burk, Peosta, IA (US)

(72) Inventor: Ryan Burk, Peosta, IA (US)

( * ) Notice: Subject to any disclaimer, the term of this patent is extended or adjusted under 35 U.S.C. 154(b) by 0 days.

(21) Appl. No.: 14/249,969

(22) Filed: Apr. 10, 2014

(65) Prior Publication Data

US 2015/0040803 A1 Feb. 12, 2015

Related U.S. Application Data

(60) Provisional application No. 61/865,012, filed on Aug. 12, 2013.

(51) Int. Cl.
*B65D 19/00* (2006.01)

(52) U.S. Cl.
CPC ..... *B65D 19/0038* (2013.01); *B65D 2519/00034* (2013.01); *B65D 2519/00069* (2013.01); *B65D 2519/0094* (2013.01); *B65D 2519/00268* (2013.01); *B65D 2519/00288* (2013.01); *B65D 2519/00308* (2013.01); *B65D 2519/00318* (2013.01); *B65D 2519/00338* (2013.01); *B65D 2519/00955* (2013.01)

(58) Field of Classification Search
CPC ..... B65D 19/0012; B65D 19/0026
USPC ..... 108/57.25, 57.17, 57.3
See application file for complete search history.

(56) References Cited

U.S. PATENT DOCUMENTS

| | | | | | |
|---|---|---|---|---|---|
| 3,424,110 | A * | 1/1969 | Toot | B65D 19/004 | 108/53.3 |
| 3,433,184 | A * | 3/1969 | Addy | 108/53.3 | |
| 3,481,285 | A * | 12/1969 | Yellin | B65D 19/0014 | 108/57.28 |
| 3,630,157 | A | 12/1971 | Ortenbald | | |
| 3,640,229 | A * | 2/1972 | Bell | B65D 19/0018 | 108/57.28 |
| 3,720,176 | A * | 3/1973 | Munroe | 108/57.25 | |
| 4,029,023 | A * | 6/1977 | Rosewicz et al. | 108/57.28 | |
| 4,408,544 | A * | 10/1983 | Haataja | 108/53.3 | |
| 5,458,069 | A * | 10/1995 | Stolzman | 108/56.3 | |
| 6,209,464 | B1 * | 4/2001 | Elder | 108/53.3 | |
| 6,976,437 | B2 * | 12/2005 | Fisch et al. | 108/57.25 | |
| 2003/0106470 | A1 | 6/2003 | Apps | | |
| 2004/0107880 | A1 * | 6/2004 | Greene | B65D 19/0018 | 108/57.25 |
| 2006/0075939 | A1 * | 4/2006 | Shuert | 108/57.25 | |
| 2012/0048154 | A1 | 3/2012 | Toomer | | |

FOREIGN PATENT DOCUMENTS

| | | | | |
|---|---|---|---|---|
| EP | 2067708 | A1 * | 6/2009 | B65D 19/0016 |

* cited by examiner

*Primary Examiner* — Daniel J Rohrhoff
(74) *Attorney, Agent, or Firm* — Rathe Lindenbaum LLP

(57) ABSTRACT

A pallet having a unique runner system where each runner opens into the upper deck of the pallet or opens away from the upper deck, and each runner is formed of a construction of z girts back to back resulting in a flattened "V" or "U". Each runner may optionally include an elongated notch on its bottom surface or an opening to allow forklift tines to slide into for easy transport of the pallet. The pallet may also include cross runners of similar construction for additional strength. The pallet's construction allows the pallet to be made of plastic material, perhaps molded, providing lighter weight and longer durability than its wooden cousins.

19 Claims, 11 Drawing Sheets

CROSS SECTION OF V RUNNER (2) Z-GIRTS

HIGH LOAD PLASTIC PALLET

PRIORITY STATEMENT

This application a nonprovisional application based off provisional application No. 61/865,012, which was filed on Aug. 12, 2013 with the U.S. Patent and Trademark Office, the entire contents of which is incorporated herein.

BACKGROUND

The transport of objects from one place to another has been a challenge since ancient times. Storage of multiple objects also poses challenges. In addition to specialized buildings, shelves, and cupboards for storage and bucket loaders, fork lifts, trucks, carts, planes and ships for transport, pallets have been created.

Pallets can be thought of as a form of a moveable shelf or platform. Depending on the load to be moved, the construction of a pallet is critical to durability and performance. Further, it is desirable that a pallet be constructed such that a loaded pallet may be placed directly on the load of a pallet below without damaging the lower load. Some storage systems employ open racking of pallets which systems have additional requirements so that the pallets may be used in such a system.

In certain industries such as the food industry, the use of untreated wood pallets provides an entry and/or growth medium for bacteria, mold, fungus and other biological organisms which pose threats to food safety and reduce the durability of the pallet. It is also desirable to employ pallets that may be easily cleaned and recycled. Therefore, it would be desirable to employ a pallet made of material not vulnerable to such invasion, and easy to clean. Further, wood pallets are not as durable as plastic or metal pallets, and will swell and contract with atmospheric or working conditions, causing issues in their use for automated packaging lines.

In order to move the pallets and their loads, machines such as fork lifts need to be able to easily engage and lift the pallet and its load and easily disengage from the pallet after the pallet is positioned. Providing a pallet with features to provide ease of transport by forklift is, therefore, also desirable.

A problem with the use of pallets for moving and storing materials is what to do with a pallet when empty. They often are stacked but take up quite a bit of space and the stack's height is limited in order to prevent shifting and the possibility of a stack of pallets falling on someone. Adding to the danger, many present pallet designs are heavy in order to accommodate their intended uses, making their empty-stage storage and transfer both cumbersome and expensive.

Most present pallets bearing dynamic loads of 2,000 pounds or more are constructed of materials such as wood and/or metal. Others may be constructed of fiberglass and plastic. Although attempts have been made to use plastic pallets for similar loads, the designs of those pallets have been deficient in the amount of sag, and the pallet's durability and load-bearing capability. Those pallets that adequately address sag and bear adequate weight are often also heavier, requiring more materials to provide adequate functionality.

What was needed was a lightweight pallet capable of bearing a dynamic load of about 2,000 pounds or more, especially a pallet that can span a 42 inch or 44 inch open pallet rack. The pallet needed to be durable and easily stored, transported, and nested with other such pallets. Preferably, such a pallet would be a relatively low cost pallet. Pallets of different dimensions having these features would also be desirable. And if such a pallet having all of these general features could be constructed to withstand more than 8 shipping cycles before repair or replacement, and made using mostly, if not all, recycled materials, the advantages could be multiplied and far outdistance the presently used wood pallet.

SUMMARY OF THE INVENTION

The present invention comprises a lightweight pallet which can be nested and stacked with other pallets. The pallet comprises a deck portion having a loading surface and a runner system. The deck and runner system are constructed to resist sag when a load is applied.

In one embodiment the pallet is a unitary structure which may be the result of a molding process wherein the pallet is of one piece. A unitary structure is not critical to the pallet's design but lends itself well to simplifying both its construction and storage. If molded to provide a hollow or mostly hollow construction, the pallet can be relatively lightweight relative to its solid brethren. For example, some embodiments of the pallet range in weight between about 11 and about 20 pounds. Although not required, the pallet may be of plastic materials, or of composites that include plastic. The structure and material, combined, provides a stronger pallet than prior art pallets made of wood. The pallet of the present invention may be constructed to bear loads up to and including about 2000 pounds or more without undue sag, able to span a 42" or 44" inch open pallet rack or comprise differing dimensions, and are semi-stackable and nestable.

In any case, the pallet of the present invention includes the runner system which has at least one runner, wherein each runner comprises a first end and a second end, a top or at least one top edge, a bottom and a generally "V/U/flattened V" profile when viewed from either said first or said second end. The V/U/flattened V profile is formed by a first angled (relative to vertical) generally planar surface having a first lip which serves as the first leg of the "V" or "U", and a second angled generally planar surface having a second lip forming the second leg of the "V" or "U" wherein the two angled generally planar surfaces are angled toward one another to create, generally, a flat or rounded or pointed apex or juncture.

In one embodiment, there is an open space between the first angled generally planar surface and the second angled generally planar surface. In an embodiment, the open space upwardly opens through the deck portion. In a similar embodiment the upward opening open space is covered by the deck portion, or may be partially covered by the deck portion. In another embodiment the open space opens downward and the deck portion is associated with the V/U/flattened V profile of the juncture between the first and second angled generally planar surfaces. In another embodiment the first and second angled generally planar surfaces are hollow bodies joined and in communication through the V/U/flattened V profile. In yet another embodiment, the open space between the first angled generally planar surface and the second angled generally planar surface includes at least one leg or one plate member spanning the open space and connecting the first and second angled generally planar surfaces. In another embodiment, the open space between the first angled generally planar surface and the second angled generally planar surface includes at least one protrusion, either generally planar and perpendicular to one of said angled generally planar surface of the runner or generally nonplanar. Said protrusion spans the open space only near the juncture between the first and second angled generally planar surfaces leaving an open space or, spans the open space near the top edge of the runner, leaving the open space otherwise between the first and second angled generally planar surfaces of the runner.

A runner as described herein may span most of the distance between two portions of the deck surface, typically, substantially spanning the distance between two sides or edges. The deck portion may or may not include a lip covering the open space at an end of a runner between the first angled generally planar surface and the second angled generally planar surface, thereby sealing that end of the runner from water, debris, or pests.

A runner may, alternatively, span a distance between two other runners providing cross support. The cross support runner may be oriented at right angle to the other runner, or may be at some other angle relative to the other runner. A cross support runner may run between runners, or between a runner and an edge of the deck surface. The open space of a cross runner may be formed to open into the open space of the other runner.

The strength of each runner is accomplished by the use of Z-girts in its construction. Specifically, the first angled generally planar surface and the second angled generally planar surface are formed in a manner that provides the strength of two z-girts placed back-to-back. This shape then provides the advantages expected from the use of z-girts, and allows the load to be spanned to the first and second ends of the runner. Further, in one embodiment, the first lip and the second lip of each runner each forms an integral part of the deck portion. In one embodiment, one of said lips of each of the outermost two of said at least one runners forms an outer edge of said pallet. In an embodiment, each of the ends of each runner is provided with a third and fourth lip, respectively, which lip forms a portion of the outer edge of said pallet. In another embodiment, each lip can be at any one of many different angles from the adjoining angular surface of the "V" runner. For an example of embodiments of the present invention exhibiting these characteristics, see FIGS. 1, 2 and 3.

The inventor does not intend to limit the invention to these embodiments but, rather, the invention is directed to the use of single or multiple runners as described herein, all uniform in a given pallet, or arranged in groupings of different numbers either between the outer edges of the pallet's deck or including some that form the edges of the deck of the pallet within or on the sides of a given pallet in accordance with its intended use and load requirements. The pallet of the present invention may or may not include cross runners having similar construction, oriented at angles to the runners to provide additional strength.

The V/U/flattened V bottom of each said runner may be uniform on the runner or may further comprise contours which create at least one elongated notch, also having a V/U/flattened V bottom. Said notch allows a fork on a lift to slide between two loaded and stacked pallets and remove the upper pallet for transfer. When nested with another pallet, the whole stack may be lifted via the notch on the bottom pallet, or a single pallet may be lifted between runners. Devices other than a fork lift may be used. Several notches may be present and can be of dimensions selected for ease of transfer, depending on the machine anticipated to be used for such transfer. Alternatively, the runner may be formed to enclose an opening transverse to the runner's orientation through which a lifting device may be inserted. See FIGS. 3 and 5 for examples of the contours where a pallet is intended to be used in an open rack, moveable by fork lift, and nestable with others of like design.

In one embodiment, the V/U/flattened V includes open space between the first angled generally planar surface and the second angled generally planar surface, and the open space is not occluded by decking. Where this construction is present, a first pallet may be stacked and nested with another. When nested the V/U/flattened/V runner of an upper pallet is nested into the open space between the first angled generally planar surface and the second angled generally planar surface of a runner of a lower pallet.

In another embodiment, at least one of said at least one runner is present in a runner unit. A runner unit comprises more than one runner, closely positioned together so that each said runner comprises a first angled generally planar surface, a second angled generally planar surface, and at least one joining lip. The joining lip is shared with an adjacent runner in the runner unit and is positioned between two neighboring runners. Each of said angled generally planar surface of each runner in the unit is formed in a manner such that the combined first and second surface of each runner provides the strength of two z-girts placed back-to-back. See FIG. 7 which comprises a drawing showing the configuration of the Z girts relative to one another and the overall structure of the runner. It is possible that a plurality of more than two runners may be so associated in a runner unit.

A cross runner, ribs, or solid decking may be employed to add strength and rigidity. In some embodiments, a cross runner or rib may run between and be associated with at least two runners. A cross runner may or may not comprise the V/U/flattened V construction.

DETAILED DESCRIPTION OF DRAWINGS

Figure 8:
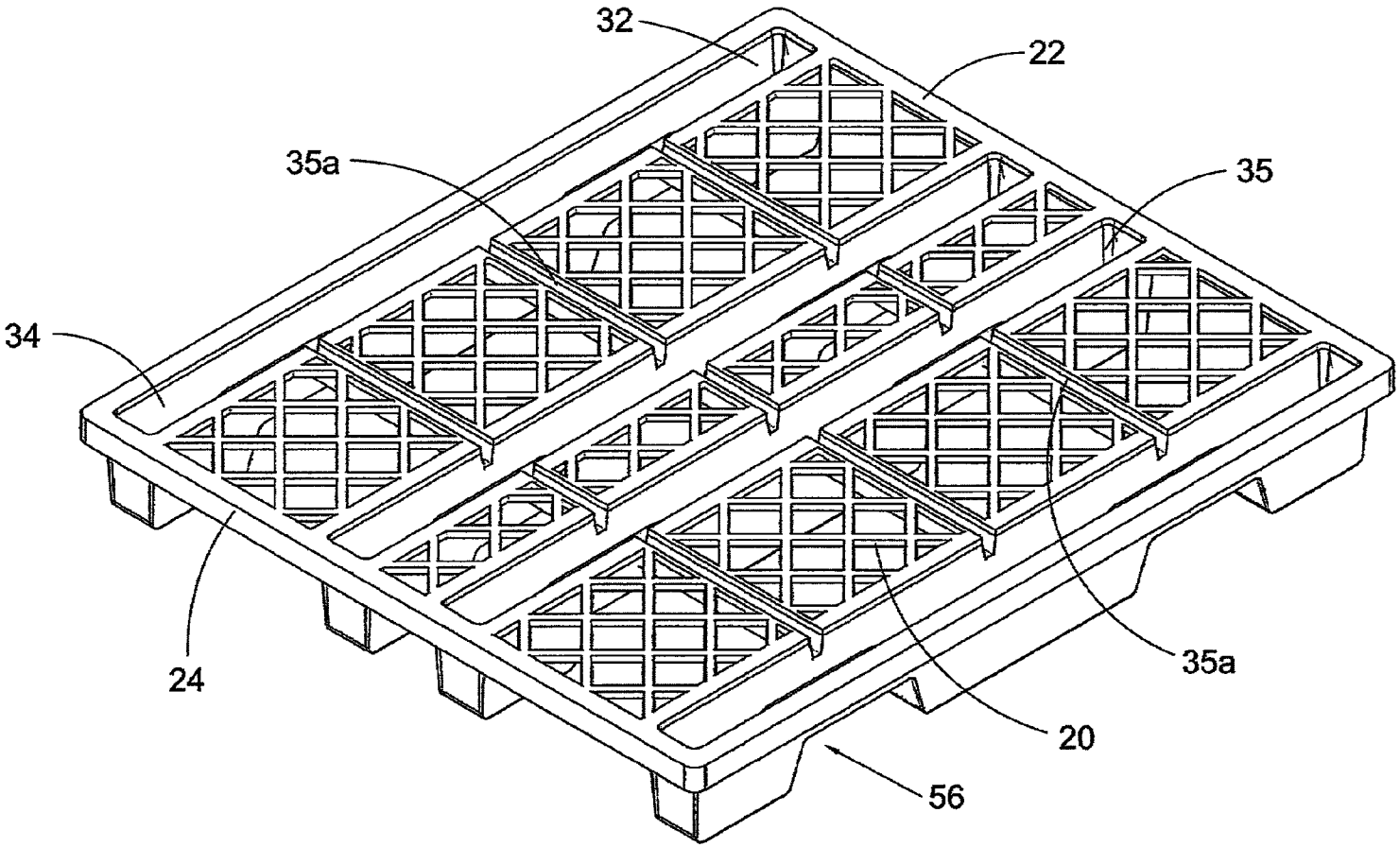
FIG. 8 depicts a fourth embodiment comprising cross runners.
Figure 9:
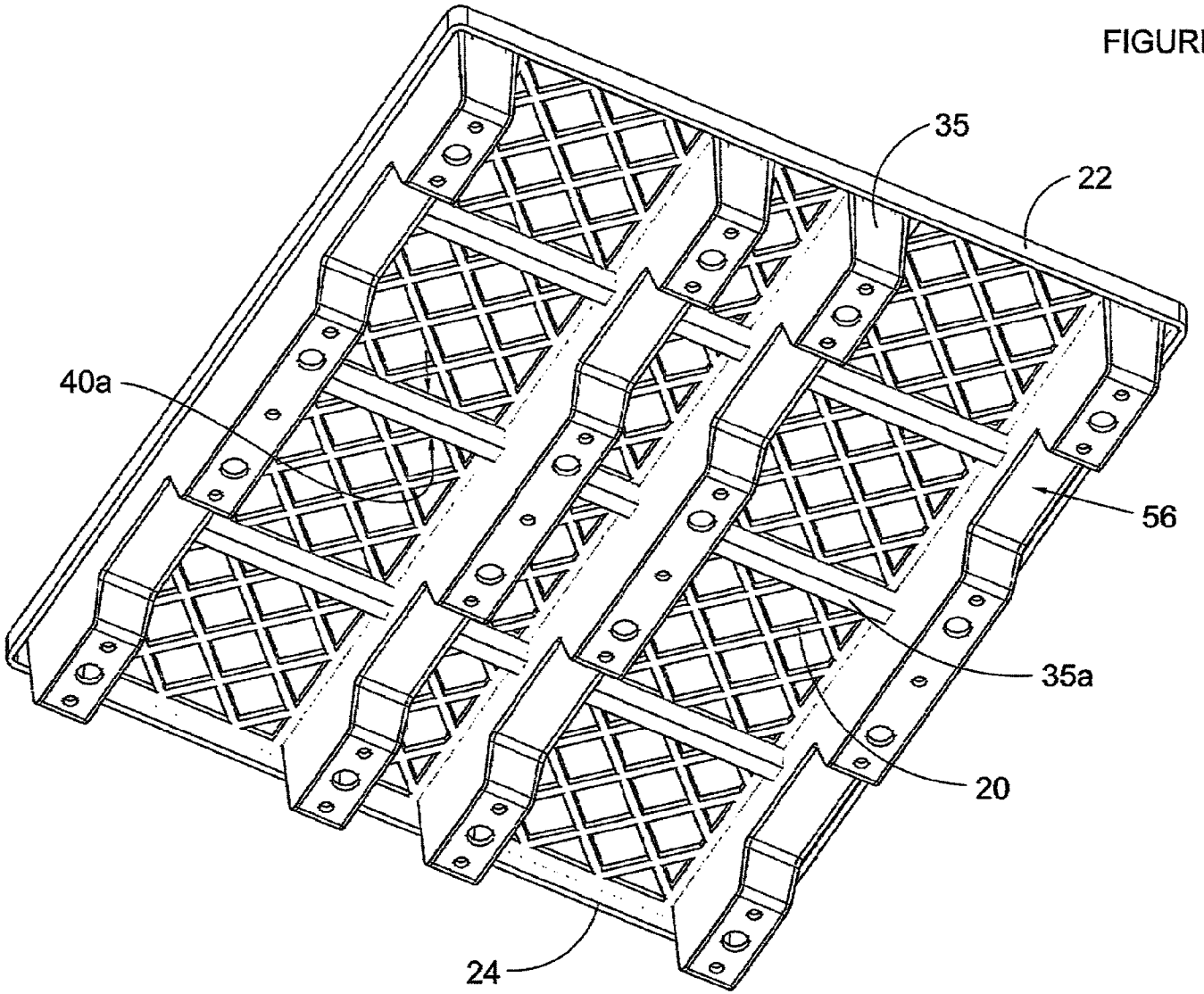
FIG. 9 shows the underside of the fourth embodiment.
Figure 10:
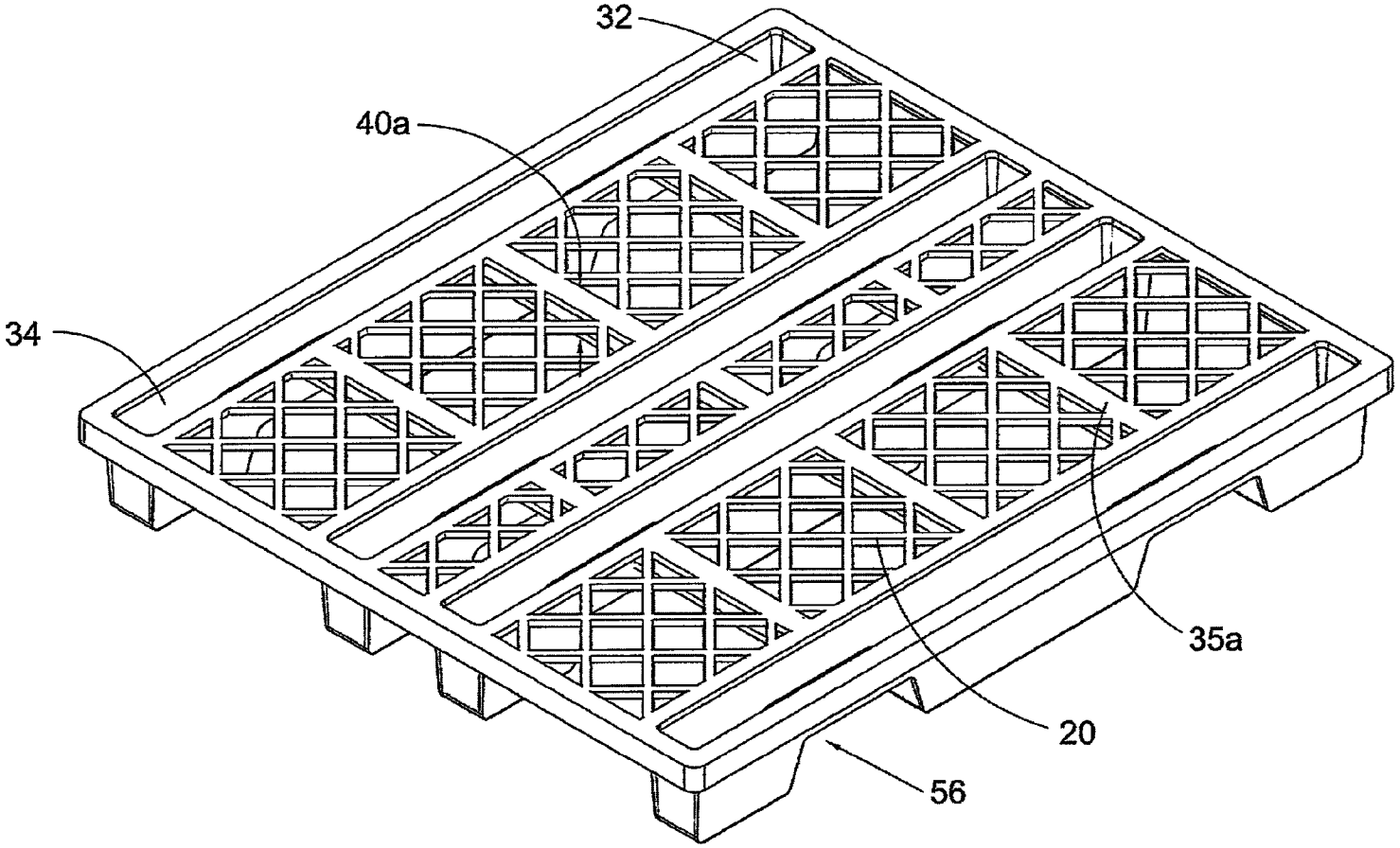
Figure 11:
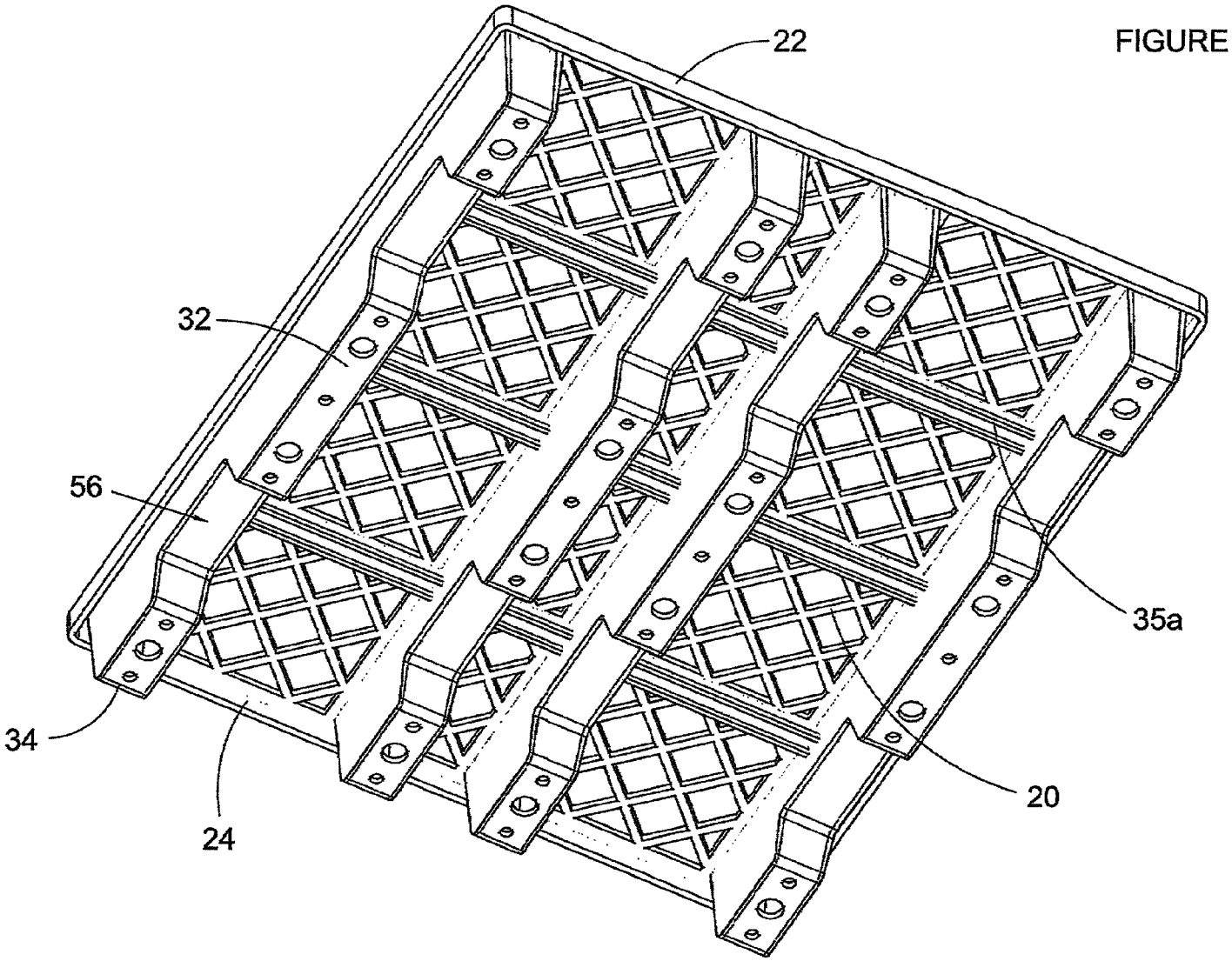

FIG. 10 a fifth embodiment with cross runners inverted from those in FIG. 8;

FIG. 11 shows the underside of the fifth embodiment.

10 pallet
20 deck portion
22 first edge of deck portion
24 second edge of deck portion
30 runner system
32 first end of runner
34 second end of runner
35 runner
**35*a*** cross runner
36 top of runner
38 bottom of runner
40 depth of runner
**40*a*** depth of cross runner
42 V/U/flattened V profile, end view
44 first angled surface
46 first lip

48 second angled surface
50 second lip
52 apex or juncture
54 open space between first and second angled surface
56 elongated notch

DETAILED DESCRIPTION

While not wishing to be limited to the following characteristics, one exemplary embodiment comprises a pallet made by a molding process which may be one of several types including but not limited to structural foam molding and injection molding using thermo plastic polymers, said pallet having overall dimensions of between about 48" to about 36" length, about 48" to 36" width, and a runner depth (from deck to V/U/flattened V bottom) of between about 2.5" and about 8". The runner opening into the deck is preferably between about 1" to 4" wide but may be wider or narrower depending on the desired load capacity of the pallet and the specific runner system design. It is possible to mold the pallet of single layer construction, or to employ rotational molding and create a pallet that is double-walled construction and/or hollow at least in part. The thickness of material can be selected to provide strength as needed for the pallet's intended use.

The pallet of the present invention is typically lighter but stronger than most similarly dimensioned wood pallets. The present invention ranges between about 11 pounds and about 20 pounds depending on its intended use. For example, a pallet comprising a runner system of the present invention weighing about 14 pounds will bear the same load, and be far more durable than a wood pallet of the same dimensions weighing 45 pounds.

Finally, in many industries, such as the food industry, the present invention offers an advantage in that the pallet may be anti-microbial or, at least, impermeable to microbial materials.

Pallet 10 comprises a first edge 22 and a second edge 24, a runner system 30 and a deck portion 20. In this embodiment, the runner system 30 comprises at least one runner 35 having a first end 32, a second end 34, a top 36, a bottom 38, a depth 40, and an end profile 42. The profile 42 may be described generally as a "V" or "U" or a flattened "V" and has a first angled surface 44, a first lip 46, a second angled surface 48, a second lip 50, an apex or juncture 52 where said first angled surface 44 and said second angled surface 48 come together, and an open space 54 between said first angled surface 44 and said second angled surface 48. Each runner 35 of the runner system 30 preferably extends the length of the deck portion 20. The bottom 38 of the runner 35 may include means to facilitate ease of transport 56. Said means to facilitate transport may include an elongated notch or notches into which the tines of a forklift may be inserted. The notch or notches 56 on a first runner are aligned with the notch or notches 56 of a second runner 35 in a runner system 30 so that the tines of a forklift may be inserted through all aligned notches. The dimensions (width and depth) of means to facilitate transport may be selected when making the pallet 10 and correspond with its intended use. Said means may even take the form of openings, rather than notches, through which transportation means (including forklift and means other than forklifts) may be threaded. This same means to facilitate transportation may also serve as means for lashing several loaded pallets together, for example, by rope or cable.

The means to facilitate transportation 56 on one runner 35 may not be the same as on another runner; further, the runners 35 on a single pallet 10 may not all be of equal depth 40. These features provide multiple use and design possibilities, allowing flexibility and applicability in a multitude of uses.

The runner system 30 typically comprises more than one runner 35. Each runner 35 in the system 30 may be adjacent directly with another runner or runners 35, perhaps connected by their respective first lips 46 and second lip 50. A runner system 30 may or may not include one or more cross runners 35*a*. A runner system 30 may be any of several patterns. Many functional runner systems 30 include a runner 35 with a first end 32 located at the pallet's deck portion first edge 22 and stretching to the pallet's deck portion opposite and second edge 24 where the second end 34 is located. In other words, a runner 35 may stretch generally across the pallet's dimension of the pallet of the present invention, but this extension is not required for acceptable functionality. Cross runner 35*a* may run between two runners 35 of the runner system 30 at any one of many angles to the runners 35 of the runner system 30. A cross runner 35*a* provides additional strength and may be oriented with its open space 54 open the same direction as the runners 35 in the runner system 30 or may be oriented oppositely. The depth 40*a* of a cross runner may be less than the depth 40 of a runner 35, to allow ease of nesting. The open space 54 of the cross runner 35*a* may open into the open space 54 of a runner 35, or may not. The open space 54 of a cross runner 35*a* may or may not open into the deck portion. This structure, then, allows identical pallets to be nested when not in use; the bottom 38 of a runner 35 on a first pallet will fit into and align with the open space 54 of a runner 35 on a second pallet. It is also possible that the cross runners 35*a* may be nested with cross runners 35*a* of another pallet. Two pallets having identical runner systems 30 can, therefore, nest. A pallet having fewer runners in its system may also nest above a pallet with more runners, if the runners have correct and corresponding spacing. This nesting feature provides for storage of multiple pallets in far less space than required for conventional pallets. Where the pallets of made of plasticized material, the weight of each pallet is far less than an equal duty wood pallet. Further, the durability of the plastic pallet far outlasts that of a wooden pallet. And, lastly, the material may be selected to allow unitary structure via molding, and may offer antimicrobial features, or at least impermeability to microbial substances.

Figure 1:
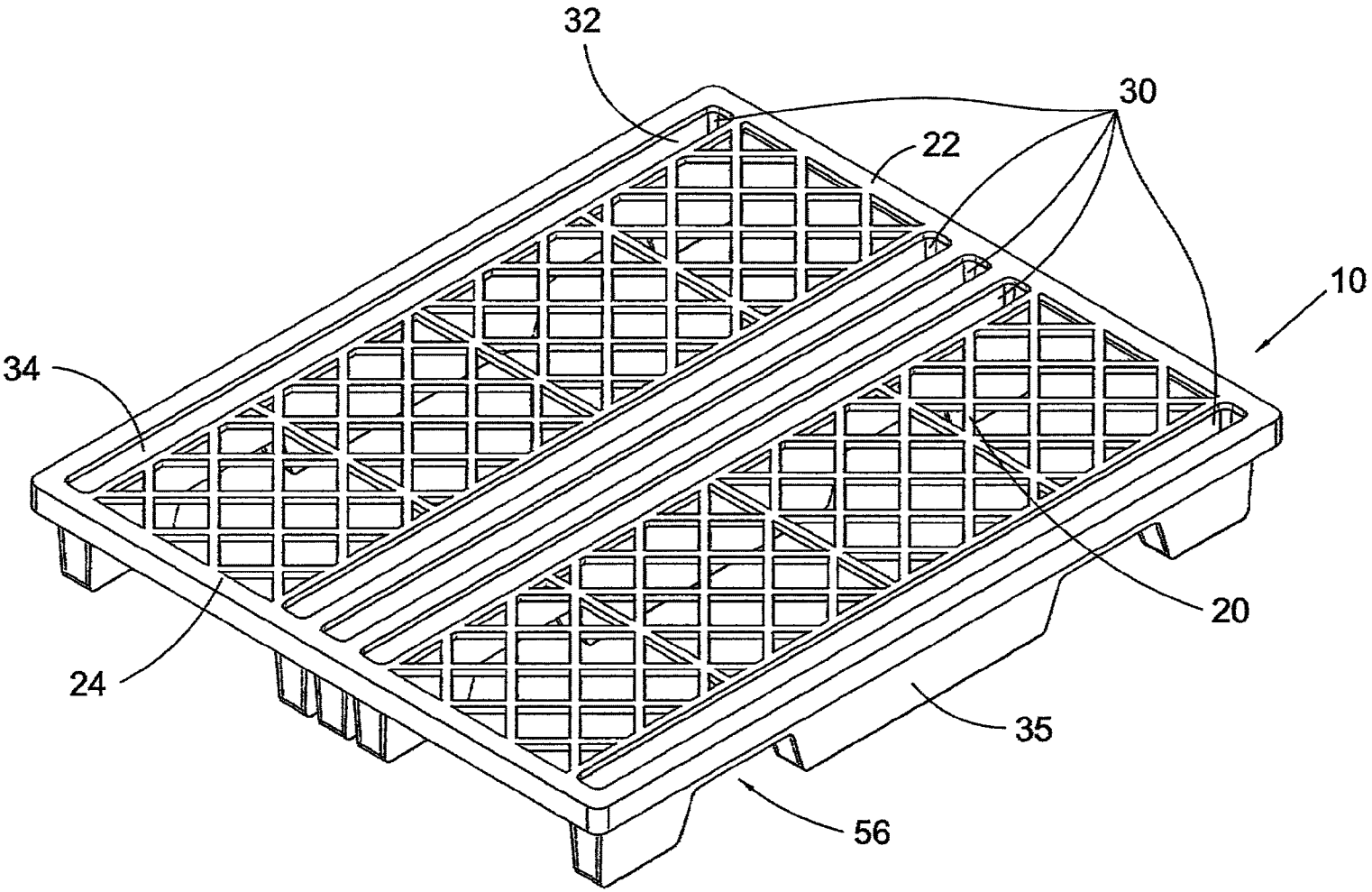
FIG. 1 depicts one embodiment of the pallet of the present invention.
Figure 2:
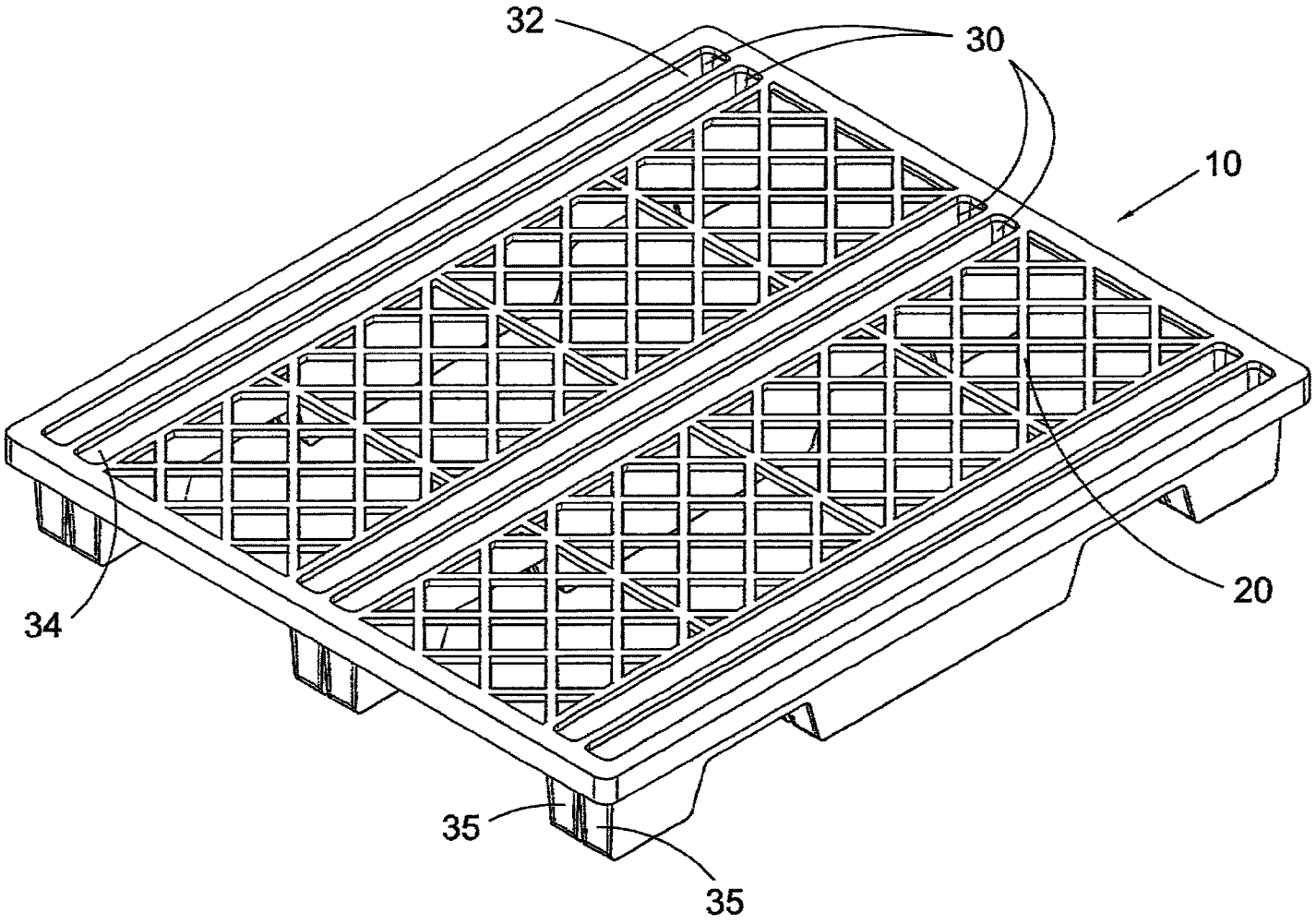
FIG. 2 shows a second embodiment of the present invention.
Figure 3:
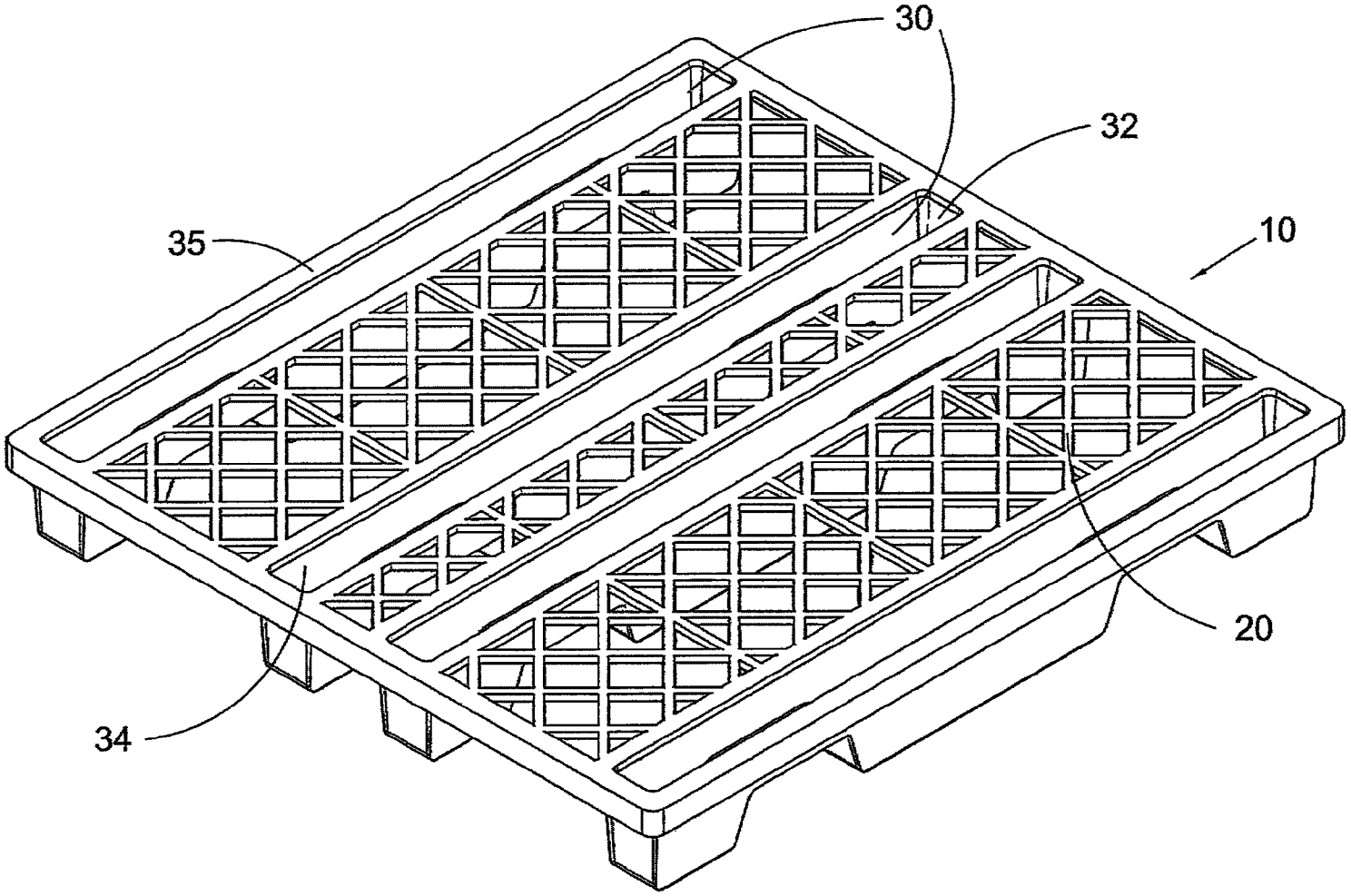
FIG. 3 depicts a third embodiment.
Figure 4:
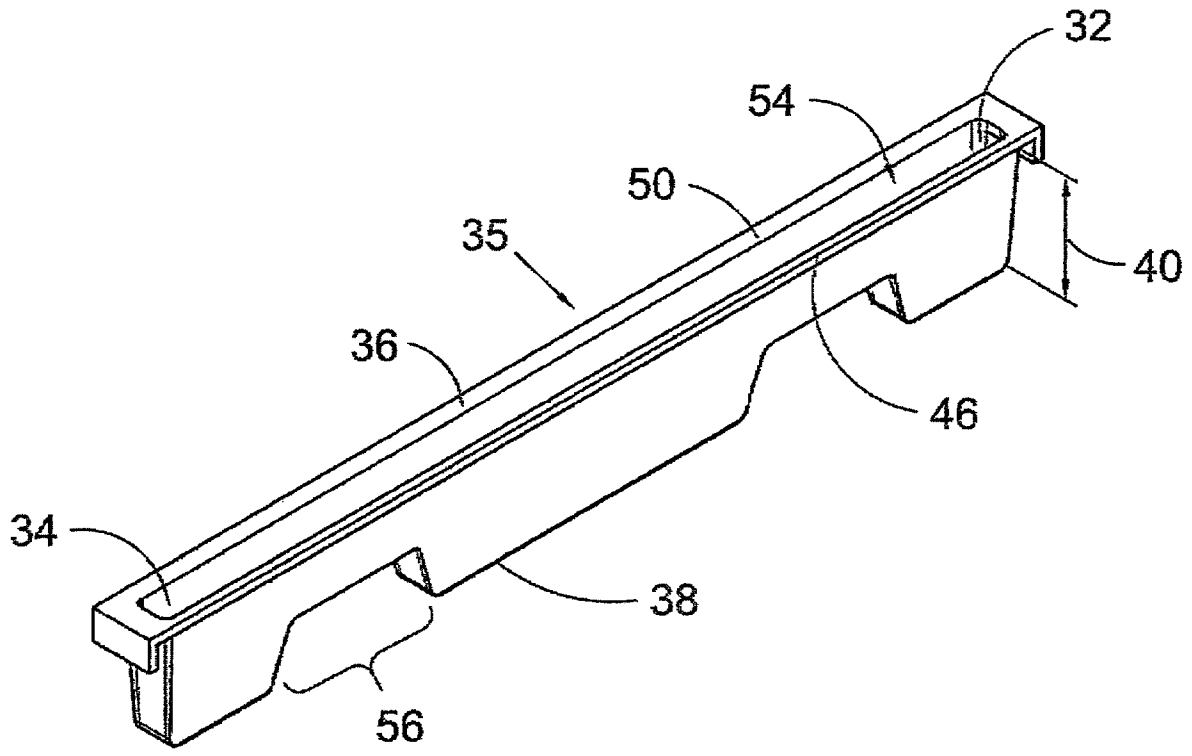
FIG. 4 is a perspective of a single runner.
Figure 5:
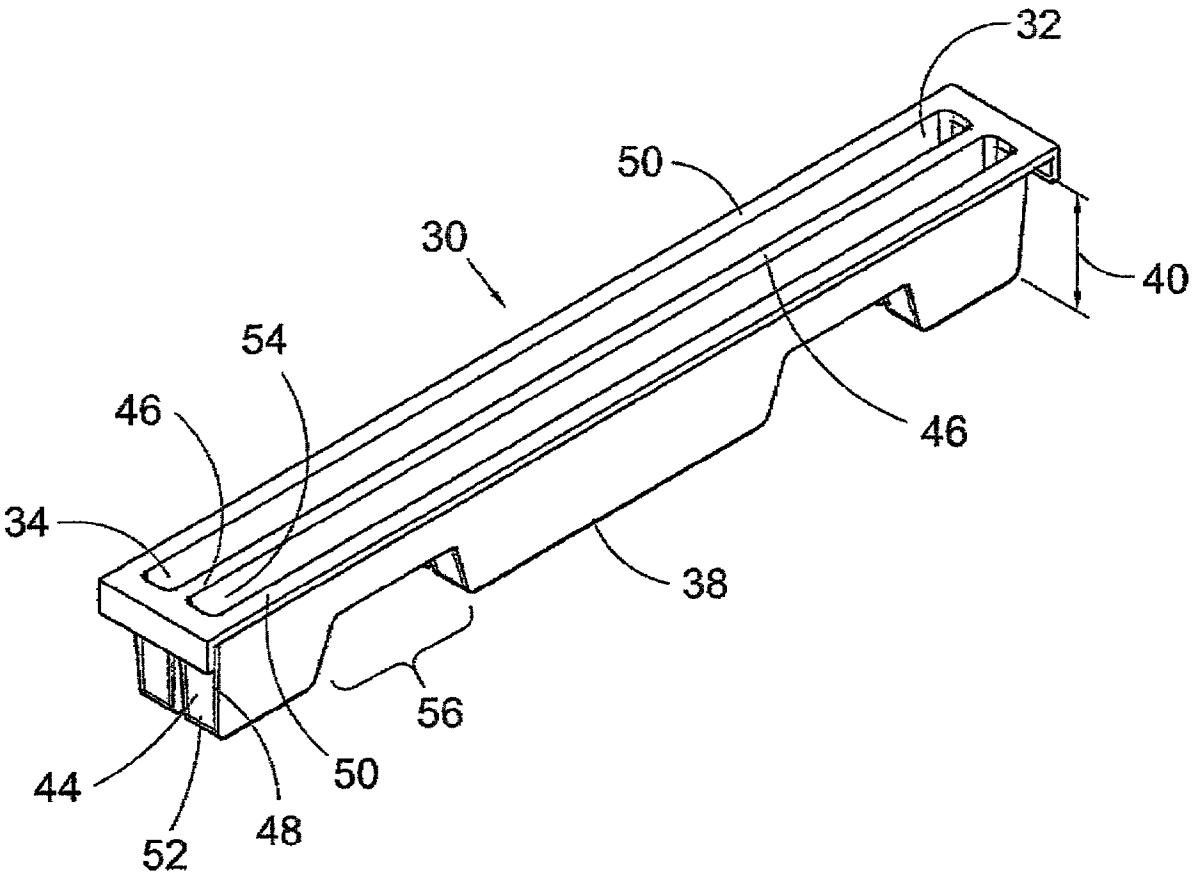
FIG. 5 is a perspective of a double runner
Figure 6:
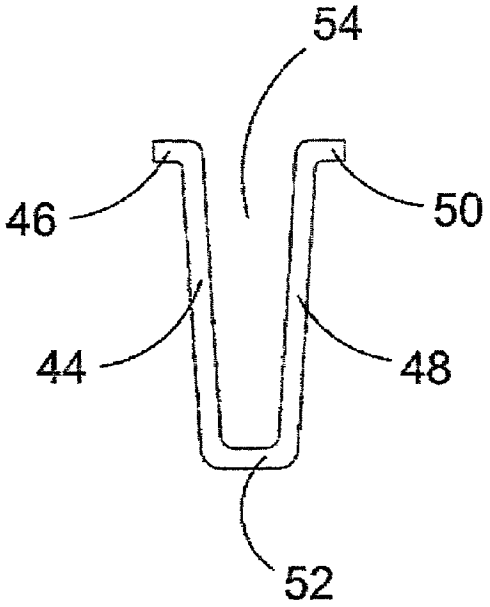
FIG. 6 is a drawing of an end view of a runner.
Figure 7:
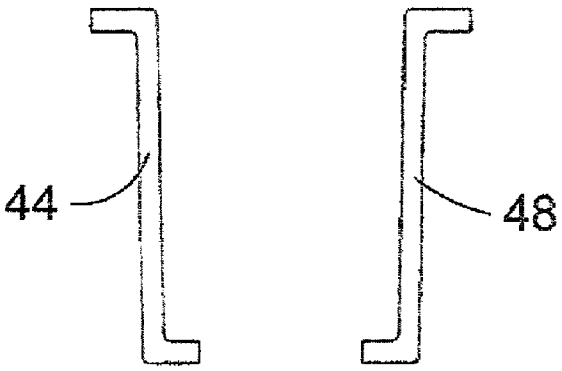
FIG. 7 is a sketch showing the two z girts placed back to back for strength.

The flattened "V" profile 42 formed at the bottom 52 of runner 35 by the meeting of the first angled surface 44 and the second angled surface 48 is key to the pallet's strength as well as its ability to nest. Referring now to FIGS. 6 and 7, specifically FIG. 7, it will be noted that a runner 35 is formed by z-girts placed back to back. The lower part of each z-girt becomes integral with the lower part of the other; the first angled surface 44 of the runner 35 comprises the first z-girt; the second angled surface 48 of the runner 35 comprises the second z-girt. This use and relative arrangement of integrated z-girts provides the superior strength of this pallet, allows the pallet to be of unitary structure, if desired, and provides its nesting capability. Alternatively, the runner 35 may be placed with the bottom 52 against the deck platform with the open space 54 opening downward. When the pallet is made of plastic material, the pallet provides superior strength, pound for pound, while also resisting infestation or contamination by biological organisms and materials.

It should be appreciated that the runner system may include a variety of groupings of runners; that the pallet does not have to be of unitary structure, and is not required to be made of plastic material. The deck portion 20 on the pallet is shown as a web, although a web is not a critical requirement for the invention. If a web is used, or a partial web, the web pattern may be one of many including openings and angles selected to provide strength and functionality as needed for the pallet's desired and intended uses. Alternatively, the deck portion 20 may be solid without openings, contoured for specific uses, or planar. Rib structures rather than or in addition to cross runners 35*a* may also be employed to add rigidity and strength. Legs or walls 56 or partial walls may also span the open space between the angled walls 44 and 48 for added strength and rigidity. Where such leg or partial wall is located near the juncture of the walls 44 and 48, the nesting ability may be maintained.

The present invention has been described in both specificity, and with generality. It is not intended to be limited except as the claims language requires. To that end, the material used to make the pallet may be of several blends of plastic, fiberglass, or combinations with wood or metal. The pallets may include a variety of means to secure one to another and may be of any general dimensions (width length) or of any shape. The runners are intended to include the open space between the legs for the purpose of nesting, but this may be accomplished in one of many ways. And nesting per se is not required.

What I claim is:

1. A pallet comprised substantially of plastic having a deck portion comprised of a plurality of intersecting ribs and a runner system comprising at least two runners wherein each said runner comprises first and second z-girts arranged back-to-back along an entire length of its respective runner and connected by a juncture so as to form a continuous uninterrupted channel in an upper side of the pallet, the channel continuously extending along a length of the runner across a majority of a length of the pallet, the channel having a uniform uninterrupted width, recessed from the upper side of the pallet, along an entire length of the channel, each of the first and second z-girts comprising a first surface forming the juncture and forming a floor of the channel, a second surface forming the upper side of the pallet and an angled surface obliquely extending from the first surface to the second surface along the entire length of the channel, diverging outwardly away from the other of the first and second z-girts, wherein the first and second z-girts are directly connected to one another by the junction along the entire length of the continuous uninterrupted channel across the majority of the length of the pallet.

2. The pallet of claim 1, wherein the pallet comprises a unitary plastic structure having a weight of less than or equal to 20 pounds.

3. The pallet of claim 1 further comprising at least one cross runner oriented at an angle between and associated with the at least two runners.

4. A plurality of pallets of claim 1 wherein said pallets are nestable relative to one another by aligning each runner of an upper pallet with a runner of a lower pallet below it and allowing the runner of the upper pallet to nest within the runner of the lower pallet.

5. The pallet of claim 1, wherein the at least two runners comprises:

a first runner having a first pair of spaced notches on an underside of the pallet;

a second runner having a second pair of spaced notches on the underside of the pallet; and a third runner having a third pair of spaced notches on the underside of the pallet, wherein the first pair of spaced notches, the second pair of spaced notches and the third pair of spaced notches are each in alignment with one another.

6. The pallet of claim 1, wherein the deck portion comprises a web formed by the plurality of interconnected ribs, the web extending between, interconnected to and supported by the at least two runners.

7. The pallet of claim 6, wherein the at least two runners comprises:

a first runner along a first edge of the pallet;

a second runner along a second edge of the pallet, opposite the first edge;

a plurality of central runners between the first runner and the second runner; the first web between the first runner and the plurality of central runners, the first web being formed by the plurality of interconnected ribs; and a second web between the second runner and the plurality of central runners, the second web being formed by the plurality of interconnected ribs.

8. The pallet of claim 7, wherein each of the first runner, the second runner and the plurality of central runners comprises a pair of spaced notches on an underside of the pallet, each pair of spaced notches of each of the first runner, the second runner and the plurality of central runners being aligned with one another.

9. The pallet of claim 7, wherein the plurality of central runners comprises a first central runner and a second central runner, the first central runner and the second central runner being directly adjacent to one another, side-by-side one another, wherein the second surface of the first z-girt of the first central runner is directly connected to the second surface of the first z-girt of the second central runner.

10. The pallet of claim 7, wherein the at least two runners further comprises:

a third runner directly adjacent to the first runner, side-by-side the first runner with directly connected second surfaces; and a fourth runner directly adjacent to the second runner, side-by-side the second runner with directly connected second surfaces.

11. The pallet of claim 1, wherein the at least two runners comprises a first runner and a second runner, the pallet further comprising a cross runner extending within the deck portion and extending from the channel of the first runner to the channel of the second runner.

12. The pallet of claim 1, wherein the at least two runners comprises a first runner and a second runner, the pallet further comprising a plurality of cross runners extending parallel to one another within the deck portion from the channel of the first runner to the channel of the second runner.

13. A pallet comprising a deck portion and a runner system of generally unitary construction wherein said runner system comprises at least three, each of the at least three runners comprising first and second z-girts arranged back-to-back along an entirety of a length of its respective runner and connected by a juncture so as to form a continuous uninterrupted channel in an upper side of the pallet, the first and second z-girts forming first and second opposite interior side walls of the channel along an entirety of a length of the channel, the interior side walls of the channel continuously extending along the length of the runner across a majority of a length of the pallet, the channel having an uninterrupted uniform width, recessed from the upper side of the pallet, along the entirety of the length of the channel, each of the first and second z-girts comprising a first surface forming the juncture and forming a floor of the channel, a second surface forming the upper side of the pallet and an angled surface obliquely extending from the first surface to the second surface along the entirety of the length of the channel, diverging outwardly away from the other of the first and second z-girts, wherein the first and second z-girts are directly connected to one another by the junction along the entire length of the continuous uninterrupted channel across a majority of the length of the pallet, wherein the at least three runners comprises a first runner having a first pair of spaced notches on an underside of the pallet; a second runner having a second pair of spaced notches on the underside of the pallet and a third runner having a third pair of spaced notches on the underside of the pallet, wherein the first pair of spaced notches, the second pair of spaced notches and the third pair of spaced notches are each in alignment with one another.

14. The pallet of claim 13, wherein the channel of the first runner and the channel of the second runner open to a same plane, the pallet further comprising at least one cross runner extending substantially between the first runner in the second runner, the at least one cross runner opening the same plane.

15. The pallet of claim 13 wherein said pallet is comprised substantially of plastic.

16. The pallet of claim 13 wherein said deck portion has a first edge and a second edge separated by a distance of at least 36 inches and no greater than 48 inches.

17. The pallet of claim 13 wherein the channel of each of the at least three runners opens through the deck portion.

18. The pallet of claim 13, wherein the deck portion comprises a web extending between, interconnected to and supported by the first runner and the second runner.

19. The pallet of claim 13, wherein the first runner extends along a first edge of the pallet, wherein the second runner extends along a second edge of the pallet, opposite the first edge, and wherein the at least three runners further comprises a fourth runner directly adjacent to the third runner, side-by-side the third runner with directly connected second surfaces, the third runner being spaced from the first runner by a web and the fourth runner being spaced from the second runner by a web.

* * * * *